US008888392B2

(12) United States Patent
Pires et al.

(10) Patent No.: US 8,888,392 B2
(45) Date of Patent: Nov. 18, 2014

(54) WIPER MEMBER FOR A CONTAINER

(75) Inventors: Leo Clifford Pires, Basking Ridge, NJ (US); Roger Hwang, Maple (CA); Rahul Bose, New Delhi (IN); Manisha Kohli, New Delhi (IN); Koushik Kohli, Uttar Pradesh (IN)

(73) Assignee: Zen Design Solutions Limited, Kowloon (HK)

( * ) Notice: Subject to any disclaimer, the term of this patent is extended or adjusted under 35 U.S.C. 154(b) by 249 days.

(21) Appl. No.: 13/378,643

(22) PCT Filed: Nov. 18, 2010

(86) PCT No.: PCT/US2010/057216

§ 371 (c)(1),
(2), (4) Date: Dec. 15, 2011

(87) PCT Pub. No.: WO2011/063114

PCT Pub. Date: May 26, 2011

(65) Prior Publication Data

US 2012/0263515 A1 Oct. 18, 2012

Related U.S. Application Data

(60) Provisional application No. 61/262,909, filed on Nov. 19, 2009.

(51) Int. Cl.
*A46B 17/08* (2006.01)
*A45D 40/26* (2006.01)

(52) U.S. Cl.
CPC ..... *A45D 40/267* (2013.01)
USPC ..... 401/122; 401/121

(58) Field of Classification Search
CPC ..... A45D 40/267
USPC ..... 401/122, 121, 126, 127; 132/218
See application file for complete search history.

(56) References Cited

U.S. PATENT DOCUMENTS

| | | | | |
|---|---|---|---|---|
| 3,130,735 | A | 4/1964 | Clark | |
| 3,763,870 | A | 10/1973 | Montgomery et al. | |
| 5,490,737 | A | 2/1996 | Gueret | |
| 5,697,720 | A | 12/1997 | Lhuisset | |
| 6,010,265 | A * | 1/2000 | Bouix | 401/122 |
| 6,076,531 | A | 6/2000 | Gueret | |
| 6,375,374 | B2 * | 4/2002 | Gueret | 401/122 |
| 6,502,584 | B1 * | 1/2003 | Fordham | 132/218 |
| 2012/0039660 | A1 * | 2/2012 | Suzuki et al. | 401/122 |
| 2012/0148332 | A1 * | 6/2012 | Stredak et al. | 401/122 |

OTHER PUBLICATIONS

International Search Report, Application No. PCT/US2010/057216, dated Jan. 20, 2011.

* cited by examiner

*Primary Examiner* — David Walczak
*Assistant Examiner* — Jennifer C Chiang
(74) *Attorney, Agent, or Firm* — Patterson + Sheridan, LLP

(57) ABSTRACT

A wiper member used in a container for packaging and dispensing cosmetic or care products. The wiper member comprises a housing wherein said housing is having at least one sidewall, wherein the at least one sidewall takes up a wiping configuration and a non-wiping configuration when a component is caused to travel through the housing. In the non-wiping configuration, a lower portion of the at least one sidewall is in an unfolded position and in the wiping configuration, the lower portion of the at least one sidewall folds inwardly upon itself into said housing.

13 Claims, 11 Drawing Sheets

WIPER MEMBER FOR A CONTAINER

This application claims benefit of United States Provisional Patent Application Ser. No. 61/262,909, filed Nov. 19, 2009.

BACKGROUND

1. Field of the Invention

Embodiments of the present invention described herein generally relate to a wiper assembly and in particular, relate to a wiper assembly that performs wiping action by determining the presence of the tool to be wiped. The wiper assembly of the present invention presents a wiping and a non-wiping configuration by detecting the directional movement of the applicator.

Wiper member of the present invention can be employed in application of various products, such as for viscous cosmetics, mascara, eye liner, lip gloss, coloring strands of hair and like products.

2. Description of the Related Art

Typical packaging and applicator devices include a tubular container having a cap and in the cap is integrated a stem containing the applicator at its distal end thereby allowing the cap to serve as a handle to hold the applicator as well. Such devices generally also include a wiper element situated at the neck of the container that helps in removing the excess product on the applicator and/or stem when the applicator is withdrawn from the interior reservoir of the container. Further, the wiper element is generally made to be elastic in nature.

The aperture of the wiper element is kept less than the cross section of the applicator element and the wiper thus removes or wipes off the excess product from the applicator element as the applicator is being moved out from the container. However, the cross section of the applicator stem is usually smaller than the wiper orifice so as to ease the removal of the applicator from the container. This results in the applicator stem carrying a coating of product over its length and the periphery when being removed for usage.

In use, the user seldom applies the entire product carried on or within the confines of the applicator for example in mascara brushes, there remains a large density of product in the typical twisted-in-wire brush. Therefore, with every removal and reentry of the applicator through the wiper, there is a buildup of residue on the outer side of the wiper, that is, a reverse wiping action occurs during the return movement of the applicator that transfers the residual product from the applicator to the wiper. With frequent usage, an undesirable quantity of product collects at the entrance area of the wiper element which gets transferred onto the applicator stem with each application. This condition is messy and may cause smearing on the face, hands, or hair of the user.

In recent years several modifications have been done to overcome such limitations. U.S. Pat. No. 6,010,265 discloses a uni-directional wiper that wipes in one direction i.e. it allows for the wiping when the applicator is withdrawn and does not wipe when the applicator is put back. The disclosed wiper comprises two or more flaps capable of occupying a first scraping position, when the applicator is withdrawn from the container, and a second non-scraping position, when the applicator is returned to the container. The wiper comprises a housing and two or more flaps are connected to the wiping end of the housing wherein each flap is connected to the housing by a living-hinge. The hinge allows the flaps to occupy a first scraping position and a second non-scraping position. In the non-scraping position, the flaps pivot about a hinge and allow the applicator to pass. Similarly, U.S. Pat. No. 5,349,972 to Dirksing discloses a dual wiper mechanism including a primary wiper element and a secondary wiper element. It discloses that the primary wiper ensures that no significant tail is left on the end of the stem as the applicator is removed from the container while the secondary wiper provides wiping of the stem.

However, these wipers comprise two parts which may result in the loss of integrity of the wiper whereas a single component wiper would have better wiping efficiency. Further, a single component would give a 360 degree unbroken surface for wiping.

There are also known certain wipers having fingers at the lower end thereof, however, the fingers wipe the tip of the applicator so as to prevent blobs at the applicator end. For example, U.S. Pat. No. 6,168,334 to Fordham describes a wiper unit for a cosmetics applicator. Herein the wiper unit is provided with the resilient fingers at an obtuse angle to the axis of its orifice, and occupying at most 50% of the orifice area. The wiper device is thereby able to remove any adherent amount of material from the free end of a material applicator as it is withdrawn through the wiper device. However, the disclosed wiper fingers act when the applicator is put back in the container as well as when the applicator is taken out of the container and there is still a build up of residue on every removal and re-entry of the applicator through the wiper device. Therefore, the wiper is not able to address the reverse wiping problem.

Similarly, U.S. Pat. No. 6,502,584 by Geka Manufacturing Limited discloses a wiper with fingers which bear against an applicator rod, the rod tapering towards a stop present at the end of the rod. As the applicator is withdrawn from the container as the tapered portion passes the wiper fingers they relax until their ends contact the stop which inverts them as it passes, the fingers remaining inturned until the applicator passes them when they will revert to their relaxed state removing any blob of cosmetic from the end of the applicator. However in this case, although the wiper fingers get inturned, they help in removing the blob of product from rod end, but it still leads to transfer of product from the applicator to the wiper. This, therefore is not able to address the reverse wiping problem.

Therefore it becomes apparent from the above discussion that there exists a need for a wiper member that helps in reducing and/or eliminating the reverse wiping condition. It would also be desirable if there is provided a wiper member allowing much more efficient and precise wiping of the residue and excess product from the applicator.

SUMMARY

The present invention generally is a container for storing and dispensing cosmetic or care products. More particularly, the invention relates to a wiper member used in such a container that performs wiping action by determining the presence of the tool to be wiped. The disclosed wiper member presents a wiping and a non-wiping configuration by detecting the directional movement of the applicator thereby giving an efficient wiping of the residue/excess product. Further, such a wiper member also helps in eliminating the reverse wiping condition. The wiper member presents a wiping configuration only when the applicator is being withdrawn from the container and a non wiping configuration when the applicator is being inserted in the container.

The term "reverse wiping condition" herein refers to the transfer of residual product from the applicator onto the inner wall of the wiper when the applicator is being returned into the container through the wiper, thereby resulting in a buildup of residue on the inner wall of the wiper. With frequent usage, an undesirable quantity of product collects at the entrance area of the wiper member which then transfers onto the applicator rod with each application which is referred to as reverse wiping action.

According to an embodiment of the present invention, the wiper member in the wiping configuration helps eliminate the bulk that accumulates at the end of the stem during improper wiping. This bulk proves as an inconvenience during application of cosmetic product and causes smudging and smearing of the cosmetic product during application.

According to yet another embodiment of the present invention the wiper member comprises a housing, said housing having a proximal end and a distal end. Both the proximal end and the distal end define an opening respectively. The housing of the wiper member comprises at least one sidewall. The wiper sidewall taking up a wiping configuration and a non-wiping configuration when a component with a suitable configuration is caused to travel through the wiper member. The wiper member may take up a wiping configuration when the component is caused to travel from the distal end of the wiper to the proximal end and a non-wiping configuration as the component travels in a reverse direction. Alternatively, the wiper sidewall may take a wiping configuration when a component with a suitable configuration is caused to travel from the proximal end of the wiper to the distal end and a non-wiping configuration as the component travels in a reverse direction. The suitable configuration of the component may be, but is not restricted to, a component with a diameter more than the diameter of the orifice of either the distal or the proximal end of wiper depending on the direction of travel of the component inside the wiper member.

According to yet another embodiment of the invention the wiper member comprises a housing, said housing having a proximal end and a distal end. Both the proximal end and the distal end define an opening respectively. The housing of the wiper member comprises at least one sidewall and there are present a plurality of protrusions on the outer sidewall. The protrusions extend outwards from the outer diameter of the sidewall of the wiper member. The plurality of protrusions may occupy any suitable proportion of the outer diameter of the wiper member. Further, the protrusions may be present on the outer diameter of the outer sidewall after leaving a gap at the distal end of the wiper. This gap may be in the form of a lip. Further, the protrusions may comprise of any suitable cross-section and shape. An exemplary embodiment may include protrusions having a shape such as flange-like, disc-shaped, cilia or finger-like protrusions of any suitable cross-section. Further, the wiper outer sidewall having said plurality of protrusions is capable of being folded inwards when a component with a suitable configuration is caused to travel from the distal end of the wiper to the proximal end and in the process making the wiper member take up a wiping configuration. This suitable configuration could be, but is not restricted to, a component with a diameter more than the diameter of the orifice of the distal end of wiper. Further, as the component travels away from the wiper the wiper sidewall having protrusions unfolds and returns back to its relaxed position, thereby causing the protrusions to move outwards. Alternatively, the wiper sidewall unfolds as soon as the component comes in contact with the distal end of the wiper member while travelling from the proximal end of the wiper to the distal end of the wiper. In the wiping configuration outer sidewall comprising the plurality of protrusions folds inwards to define an interstice to capture the residue. Whereas, in non wiping condition the outer sidewall having plurality of protrusions is in its relaxed unfolded position. Also, the suitable configuration of the component may be, but is not restricted to a component with a diameter more than the orifice of either the distal or the proximal end of wiper depending on the direction of travel of the component inside the wiper member.

According to yet another embodiment of the present invention, there is provided a wiper member wherein the wiper member comprises a housing, said housing having a proximal end and a distal end. Both the proximal end and the distal end define an opening respectively. The housing of the wiper member comprises at least one sidewall. The sidewall of the wiper member of the current embodiment has an ability to condense and expand. The wiper sidewall may possess fold-lines or variable cross-sections such that are capable of being condensed when a component with a suitable configuration is caused to travel from the distal end of the wiper to the proximal end and in this process make the wiper take up a wiping configuration. This suitable configuration of the component being withdrawn could be, but is not restricted to, a component with a diameter more than the diameter of the orifice of the distal end of wiper. This suitable configuration of the component may also be, but is not restricted to, protrusions on the surface of the said component that engage with the distal end of the wiper and cause the wiper to condense into a wiping configuration. Further, as the component travels away from the wiper member, the wiper sidewall returns back to its relaxed/expanded position, thereby causing the wiper member to take up a non-wiping configuration. Alternatively, the wiper sidewall unfolds as soon as the component comes in contact with the distal end of the wiper member while travelling from the proximal end of the wiper to the distal end of the wiper. In the wiping configuration sidewall condenses to define an interstice to capture the residue. Whereas, in non wiping condition the wiper sidewall is in its relaxed/expanded position.

According to yet another embodiment of the present invention there is provided a container for packaging and dispensing a substance, for example, a cosmetic, comprising a wiper member as defined above. The container comprises a receptacle and a gripping member. The gripping member may comprise a cap, a stem and an applicator element. The cap may have a suitable locking mechanism to close the receptacle. The stem comprises a proximal end and a distal end wherein the stem is connected to the applicator element at its distal end and to the cap at its proximal end. The receptacle has an open end and a closed end thereby forming a cavity for storage of product. Further, the open end defines a neck of the receptacle. The said container further comprises a wiper member fitted onto the neck of the container. The wiper member comprises a housing, a distal end of said housing facing the inside of the receptacle and a proximal end facing the neck of the receptacle. Both the proximal end and the distal end define an opening respectively. The housing of the wiper member comprises at least one sidewall. The wiper sidewall taking up a wiping configuration when the applicator is caused to travel from the distal end of the wiper to the proximal end and a non-wiping configuration as the applicator travels in a reverse direction. Alternatively, the wiper sidewall may take a wiping configuration when the applicator is caused to travel from the proximal end of the wiper to the distal end and a non-wiping configuration as the applicator travels in a reverse direction.

According to yet another embodiment of the present invention there is provided a container for packaging and dispensing a substance, for example, a cosmetic, comprising a wiper member as defined above. The container comprises a receptacle and a gripping member. The gripping member may comprise a cap, a stem and an applicator element. The cap may have a suitable locking mechanism to close the receptacle. The stem comprises a proximal end and a distal end wherein the stem is connected to the applicator element at its distal end and to the cap at its proximal end. The receptacle has an open end and a closed end thereby forming a cavity for storage of product. Further, the open end defines a neck of the receptacle. The said container further comprises a wiper member fitted onto the neck of the container. The wiper member comprises a housing, a distal end of said housing facing the inside of the receptacle and a proximal end facing the neck of the receptacle. Both the proximal end and the distal end define an opening respectively. The housing of the wiper member comprises at least one sidewall and there are present a plurality of protrusions on the outer diameter of the sidewall of the wiper member. The protrusions extend outwards from the outer diameter of the sidewall of the wiper member. The plurality of protrusions may occupy half the area near the distal end of the housing of the wiper member. Alternatively, the plurality of protrusions may occupy any suitable proportion of the outer diameter of the sidewall of the wiper member. Further, the protrusions may be present on the outer diameter of the outer sidewall after leaving a gap at the distal end of the wiper. This gap may be in the form of a lip. Further, the protrusions may comprise any suitable cross-section and shape. The protrusions may have a shape such as cilia, flange-like, disc-shaped or finger-like of any suitable cross-section. Further, the wiper sidewall having said plurality of protrusions is capable of being folded inwards when the applicator is caused to travel from its lower end to the upper end and in the process take up a wiping configuration. Further, as the applicator travels away from the wiper the wiper sidewall having protrusions unfolds and returns back to its relaxed position, thereby causing the protrusions to move outwards. In the wiping configuration outer sidewall comprising the plurality of protrusions folds inwards to define an interstice to capture the residue. Whereas, in non wiping condition the outer sidewall having plurality of protrusions is in its relaxed unfolded position.

During operation, as the applicator is withdrawn from the receptacle, the applicator stem is wiped in usual manner whereas the applicator element while travelling from inside of the receptacle to the outside of the receptacle when comes in contact with the wiper, the wiper is caused to fold inwards such that the plurality of protrusions define an interstice and wipe the applicator member. Further, as the applicator stem is fully withdrawn, the wiper also wipes the bulk from the tip of the applicator. Therefore, the user gets an applicator with a wiped rod and a wiped applicator member. When the applicator is being returned to the receptacle, the applicator rod as well as the applicator member does not come in contact with the protrusions on the outer sidewall of the wiper member as they are in the relaxed position. The wiper member according to the present invention provides for efficient wiping of the applicator when being withdrawn from the container and further prevents reverse wiping action to take place.

According to yet another embodiment of the present invention there is provided a container for packaging and dispensing a substance, for example, a cosmetic, comprising a wiper member as defined above. The container comprises a receptacle and a gripping member. The gripping member may comprise a cap, a stem and an applicator element. The cap may have a suitable locking mechanism to close the receptacle. The stem comprises a proximal end and a distal end wherein the stem is connected to the applicator element at its distal end and to the cap at its proximal end. The receptacle has an open end and a closed end thereby forming a cavity for storage of product. Further, the open end defines a neck of the receptacle. The said container further comprises a wiper member fitted onto the neck of the container. The wiper member comprises a housing, a distal end of said housing facing the inside of the receptacle and a proximal end facing the neck of the receptacle. The sidewall of the wiper member of the current embodiment has an ability to condense and expand. The wiper sidewall may possess fold-lines or variable cross-sections such that are capable of being condensed when the applicator is caused to travel from the distal end of the wiper to the proximal end and in this process make the wiper take up a wiping configuration. The applicator and/or applicator rod may possess protrusions on its surface that engage with the distal end of the wiper and cause the wiper to condense into a wiping configuration. Further, as the applicator travels away from the wiper member, the wiper sidewall returns back to its relaxed/expanded position, thereby causing the wiper member to take up a non-wiping configuration. Alternatively, the wiper sidewall unfolds as soon as the applicator comes in contact with the distal end of the wiper member while travelling from the proximal end of the wiper to the distal end of the wiper. In the wiping configuration sidewall condenses to define an interstice to capture the residue. Whereas, in non wiping condition the wiper sidewall is in its relaxed/expanded position.

During operation, as the applicator is withdrawn from the receptacle, the applicator stem is wiped in the usual manner whereas the applicator element while travelling from inside of the receptacle to the outside of the receptacle when comes in contact with the wiper, the wiper is caused to condense at the fold-lines such that the wiper defines an interstice and wipes the applicator member. Further, the condensed wiper configuration wipes the bulk from the tip of the applicator. Therefore, the user gets an applicator with a wiped rod and a wiped applicator member. When the applicator is being returned to the receptacle, the applicator rod as well as the applicator member do not come in contact with the wiper as wiper is expanded and therefore in relaxed position. The wiper member according to the present invention provides therefore an efficient wiping of the applicator when being withdrawn from the container and further prevents reverse wiping action to take place.

These and further aspects which will be apparent to the expert of the art are attained by an adjustable applicator in accordance with the main claim.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
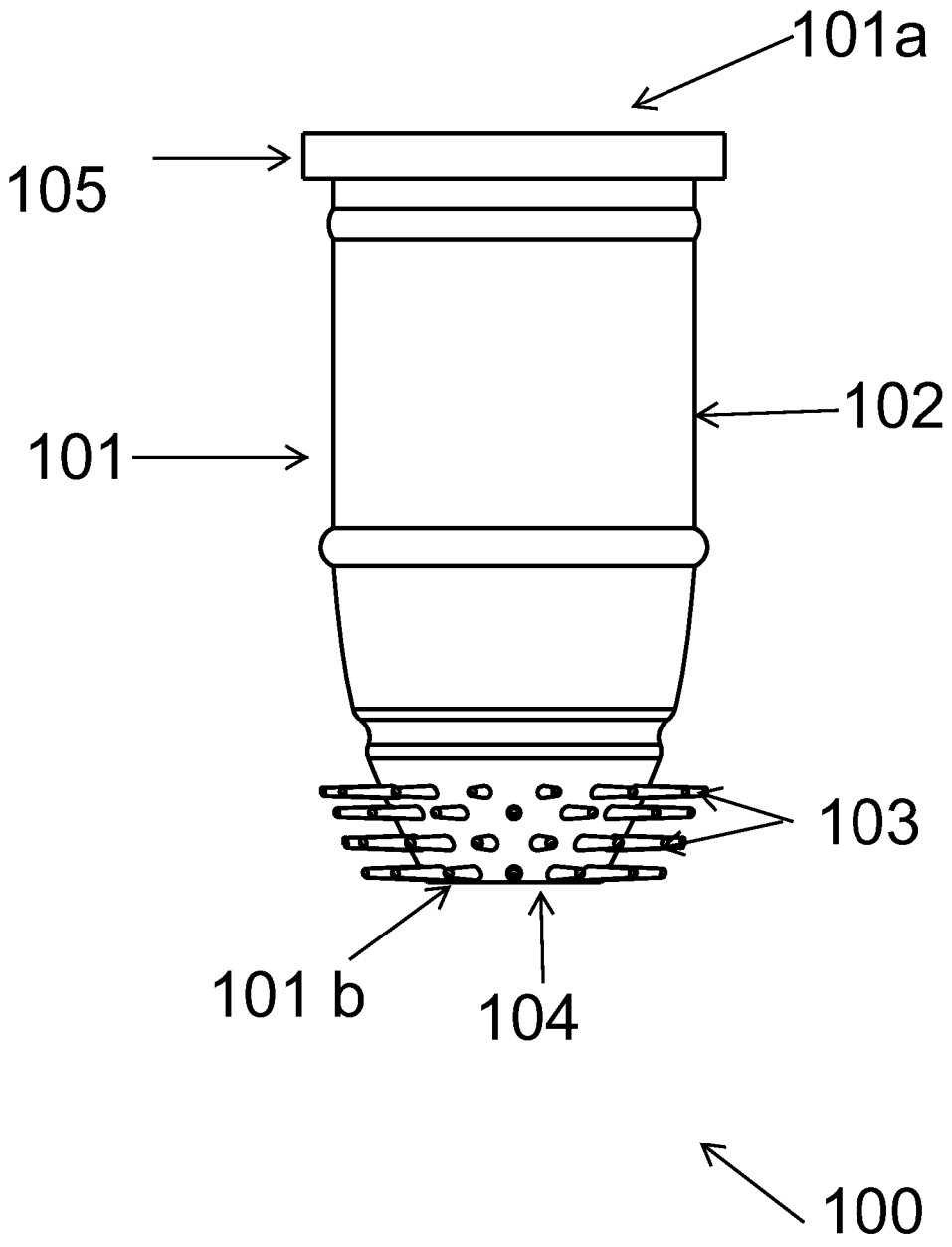
FIG. 1 illustrates an isometric view of the wiping member according to an embodiment of the invention.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

The wiper member of a container according to one embodiment of the present invention is shown in FIGS. 1 through to 5.

FIG. 1 is one embodiment of the present invention showing the wiper member 100. The wiper member 100 of the present invention comprises a housing 101, said housing having a proximal end 101*a* and a distal end 101*b*, both the ends defining an opening 104. The proximal end 101*a* further defines a neck 105. The housing 101 of the wiper member 100 comprises at least one sidewall 102 and there are present a plurality of protrusions 103 on the outer diameter of the sidewall 102. The protrusions 103 extend outwards from the outer diameter of the sidewall 102 of the wiper member 100. The plurality of protrusions 103 as shown in FIG. 1 occupy half the area near the distal end 101*b* of the wiper member, however, the protrusions 103 may occupy any suitable proportion of the outer diameter of the sidewall 102 of the wiper member 100. Further, there may be present a lip between the protrusions 103 and the distal end 101*b* of the wiper 100. Further, the protrusions 103 as seen in the figure are in the form of cilia, however, the protrusions 103 may comprise of any suitable cross-section and shape. The protrusions 103 may have a shape such as flange-like or finger-like protrusions of any suitable cross-section.

Figure 2:
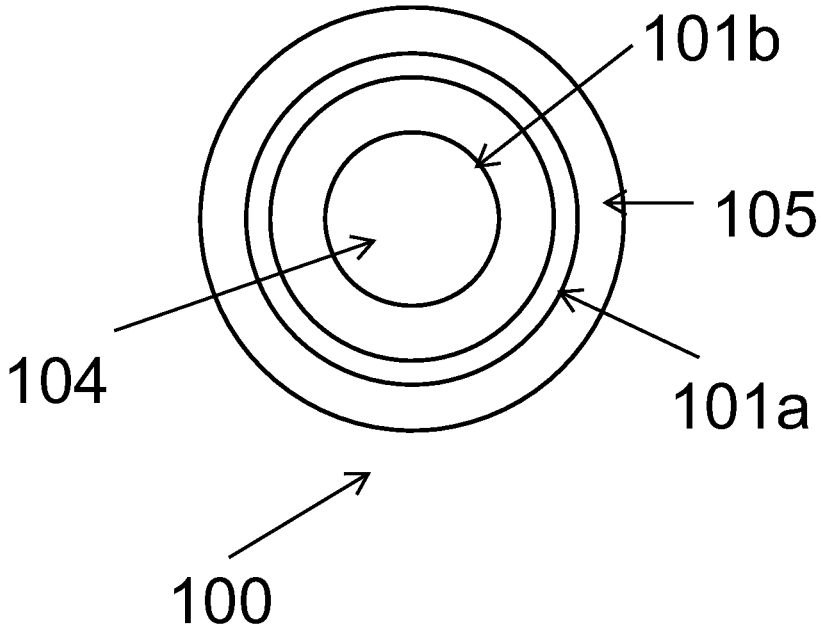
FIG. 2 is a top view of the wiping member shown in FIG. 1 in non-wiping configuration.
Figure 3:
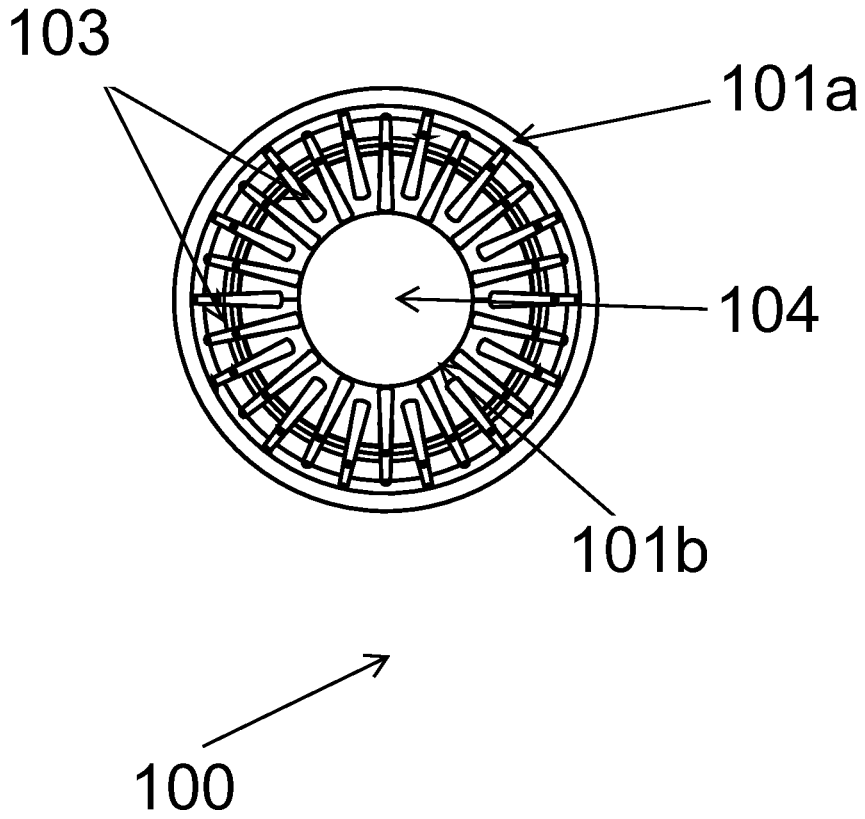
FIG. 3 is a bottom view of the wiping member of FIG. 1 in non-wiping configuration.

FIG. 2 illustrates the top view of the wiper member 100 in relaxed condition i.e. non-wiping configuration. The protrusions 103 are extending outwardly from the outer sidewall 102 of the wiper member 100. FIG. 3 represents the bottom view of the wiper member 100 in non-wiping configuration where the protrusions 103 are lying on the outer sidewall and the sidewall is in unfolded condition.

Figure 4:
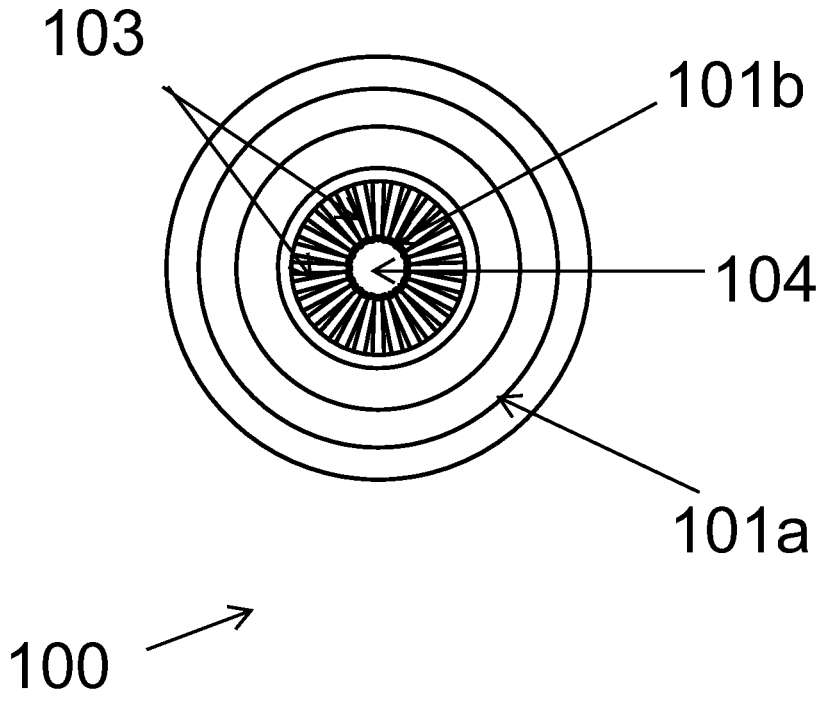
FIG. 4 is a top view of the wiping member shown in FIG. 1 in wiping configuration.
Figure 5:
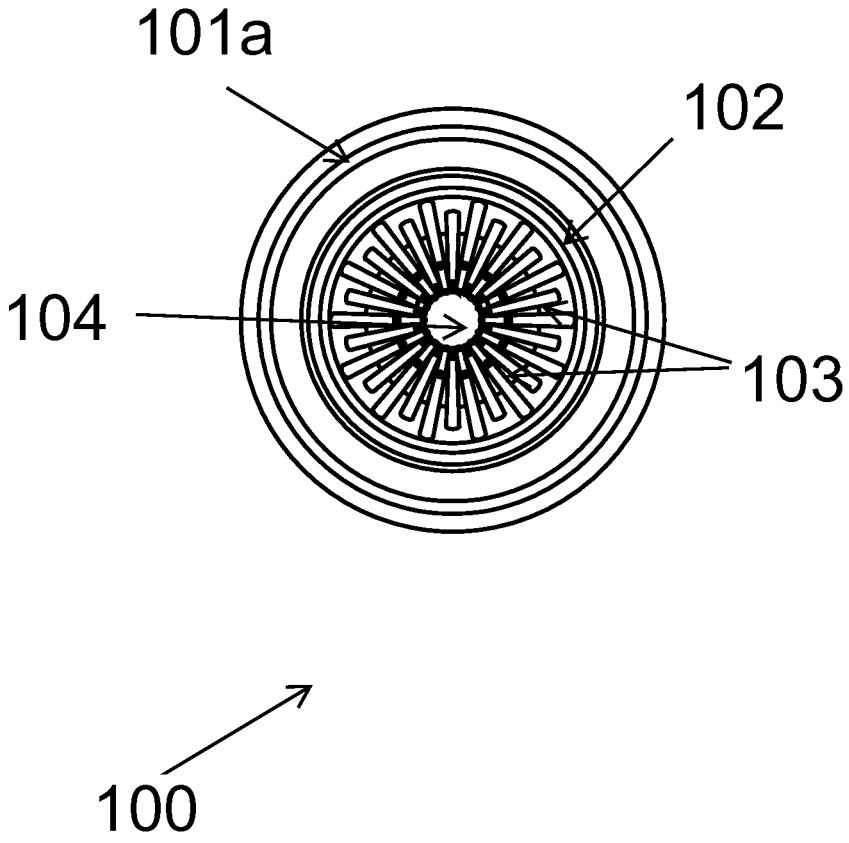
FIG. 5 is a bottom view of the wiping member of FIG. 1 in wiping configuration.

FIGS. 4 and 5 represent the top view and bottom view respectively of the wiper member 100 in wiping configuration where the outer sidewall 102 of the wiper member 100 having protrusions 103 is folded inwards. As seen in figure, the protrusions 103 are arranged so as to form an interstice.

Figure 6:
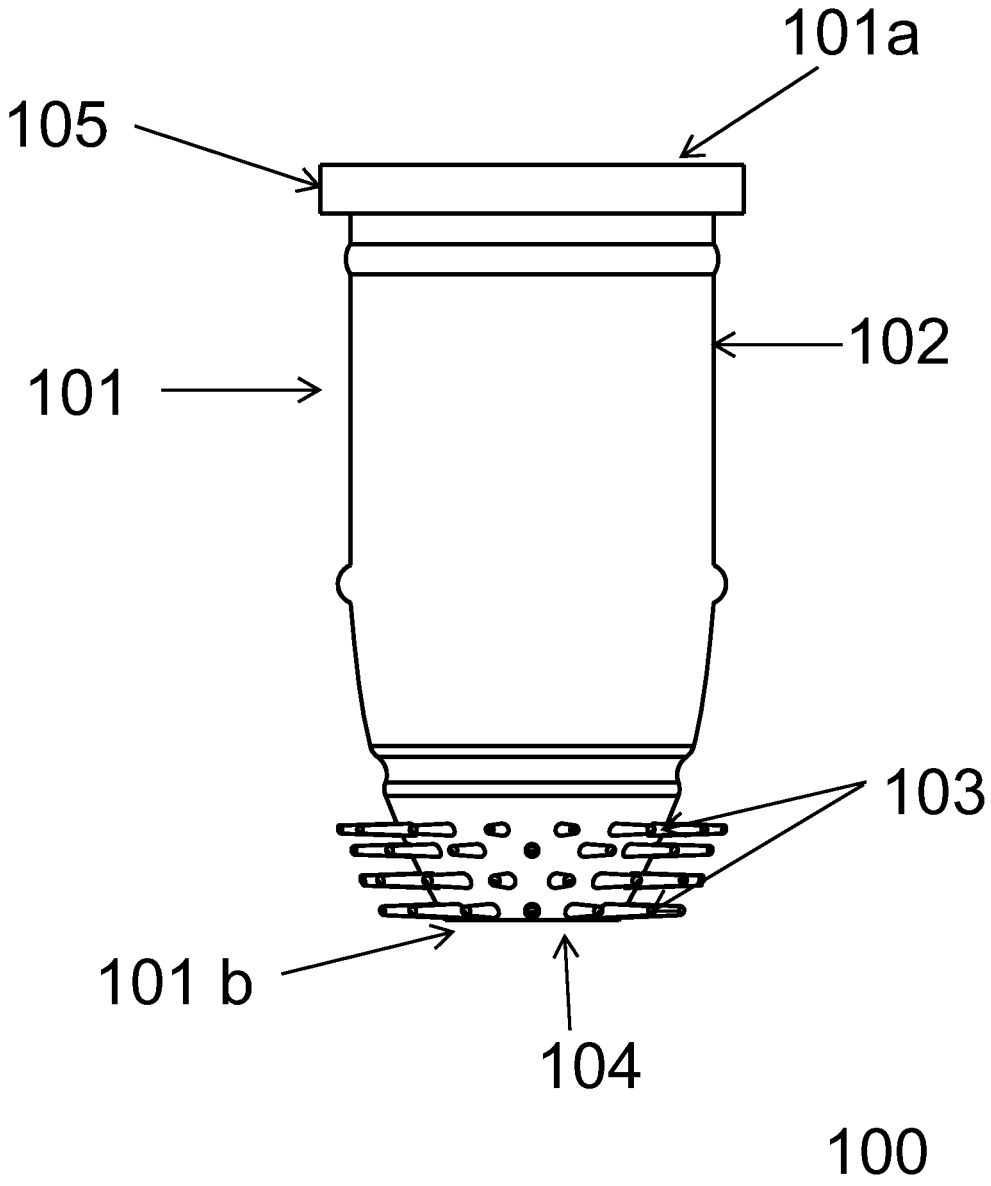
FIG. 6 is an isometric view of the wiping member according to an embodiment of the invention.

FIG. 6 shows the wiper member 100 according to yet another embodiment of the invention.

Figure 7:
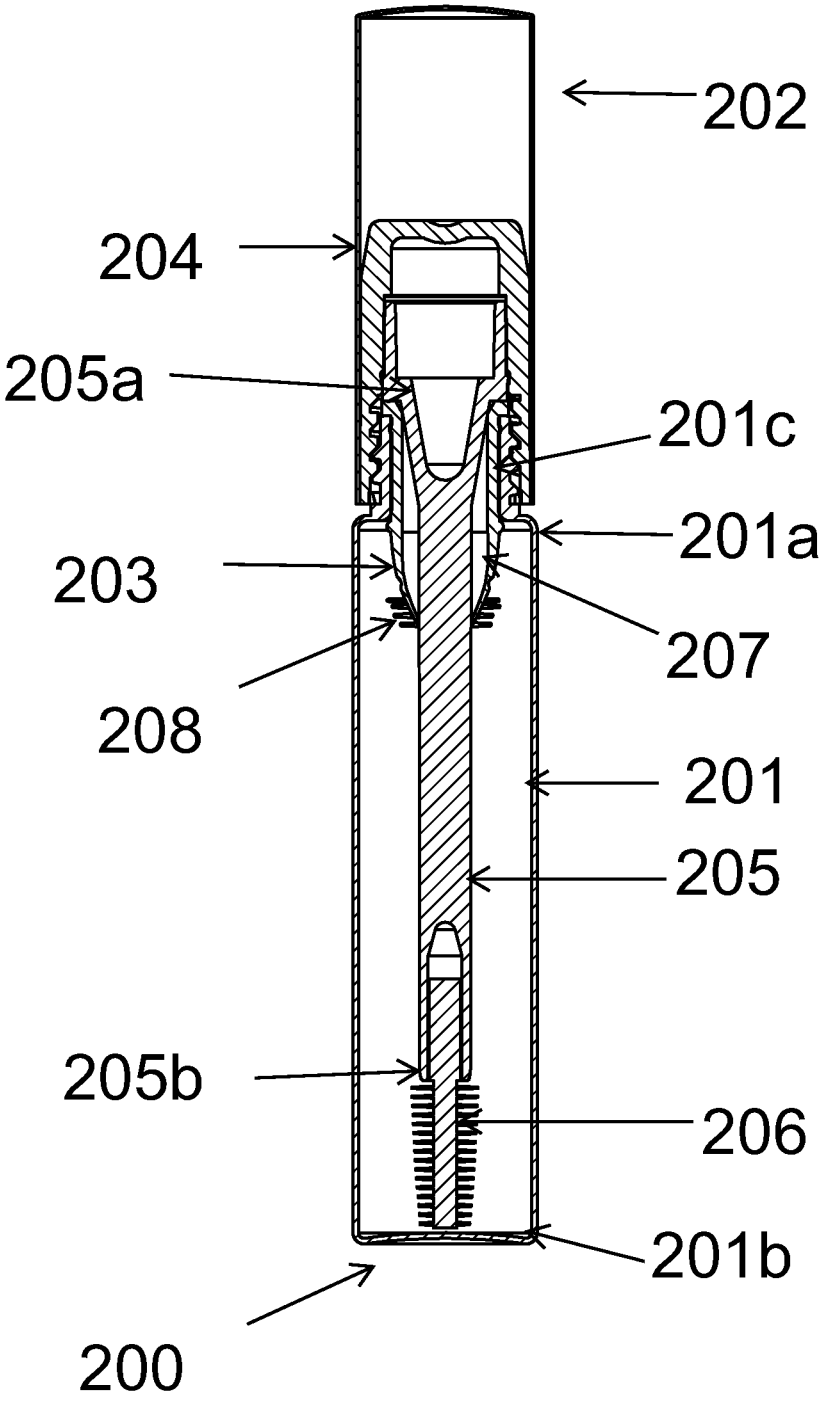
FIG. 7 illustrates a cross section view of the container comprising the wiping member according to one embodiment of the present invention.

FIG. 7 illustrates a packaging container 200 for packaging and dispensing a substance, for example, a cosmetic, comprising a wiper member 203. The container 200 comprises a receptacle 201 and a gripping member 202. The gripping member 202 comprises a cap 204, a stem 205 and an applicator 206. The cap 204 has suitable locking mechanism to close the receptacle 201. The stem 205 is having a proximal end 205*a* and a distal end 205*b* wherein the stem 205 is connected to the applicator 206 at its distal end 205*b* and to the cap 204 at its proximal end 205*a*. The receptacle 201 has an open end 201*a* and a closed end 201*b* thereby forming a cavity for storage of product. Further, the open end 201*a* defines a neck 201*c* of the receptacle. The said container 200 further comprises a wiper member 203 fitted onto the neck 201*c* of the container 200. The wiper member 203 comprises a housing 207, a distal end of said housing facing the inside of the receptacle 201 and a proximal end facing the neck 201*c* of the receptacle 201. The housing 207 of the wiper member 203 comprises a sidewall and there are present a plurality of protrusions 208 on the outer diameter of the sidewall of the wiper member 203. The plurality of protrusions 208 as shown in FIG. 7 occupy half the area near the distal end of the housing 207 of the wiper member 203, however, the protrusions 208 may occupy any suitable proportion of the outer diameter of the sidewall of the wiper member 203. Further, the protrusions 208 as seen in the figure are in the form of cilia, however, the protrusions 208 may comprise of any suitable cross-section and shape. The protrusions 208 may have a shape such as flange-like or finger-like protrusions of any suitable cross-section.

Figure 8:
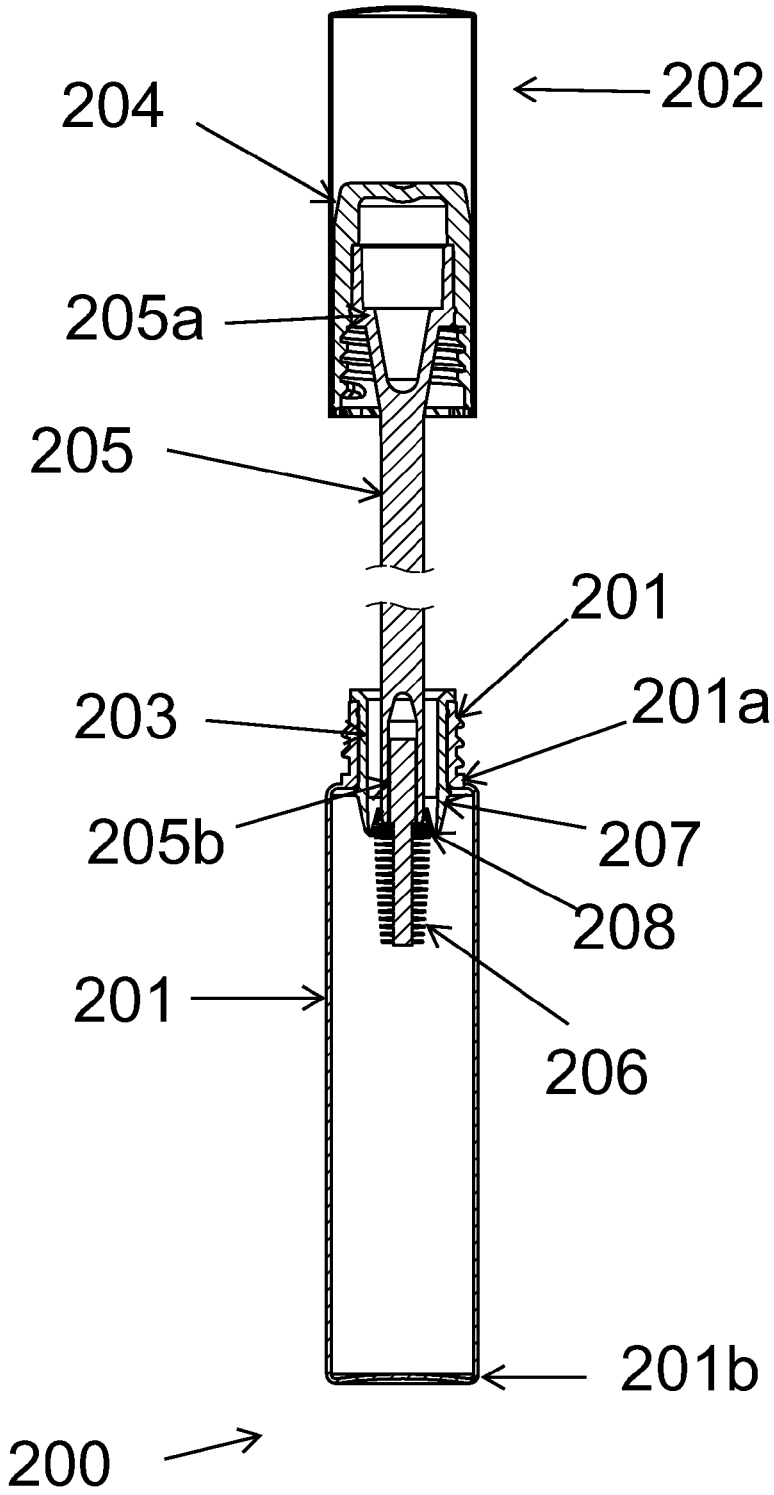
FIG. 8 illustrates a cross section view of the container as shown in FIG. 7 showing the wiping action of the wiping member on the applicator being withdrawn from the container.
Figure 9:
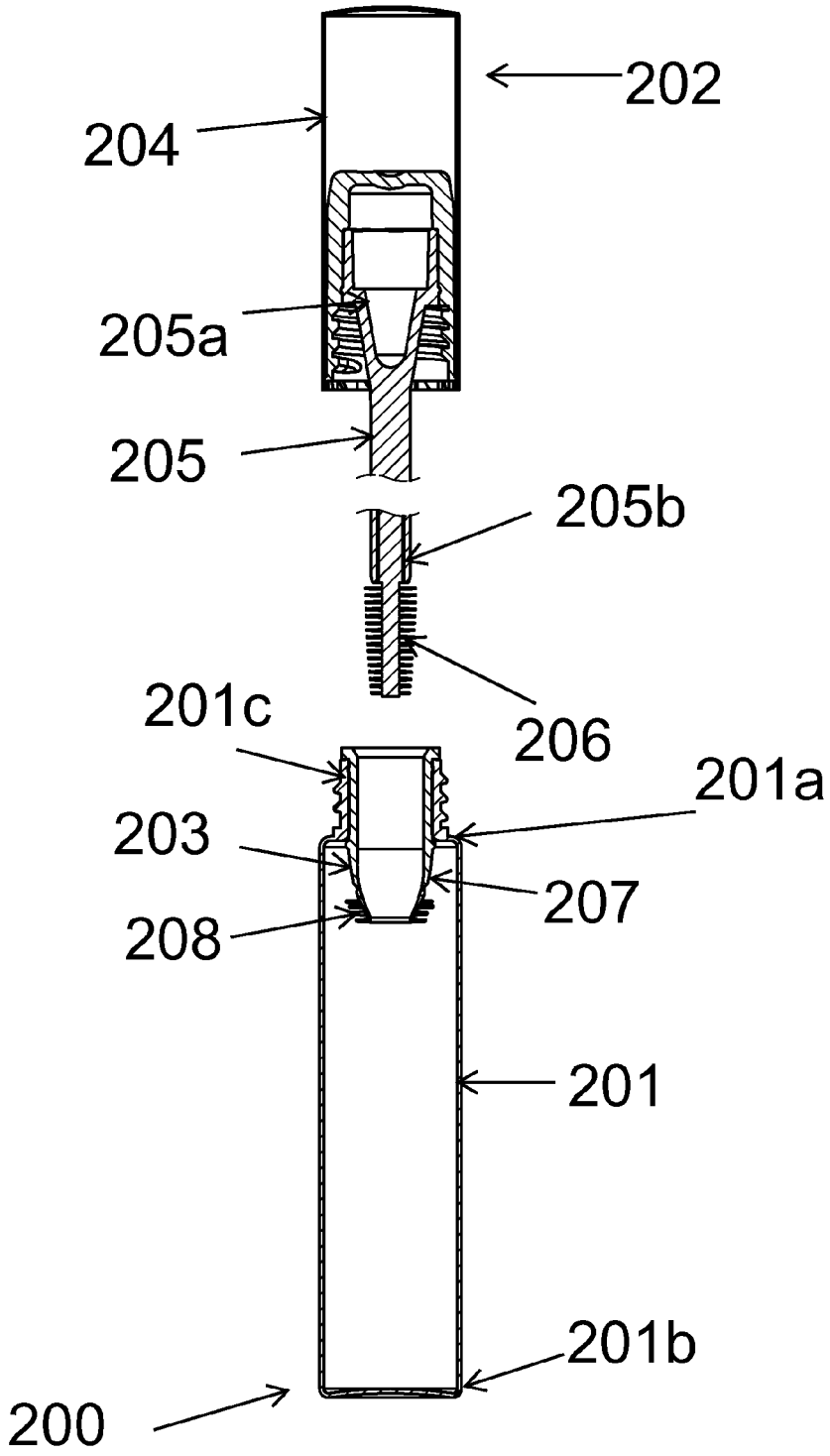
FIG. 9 is a cross sectional view of the container as shown in FIG. 7 showing the wiping member in a relaxed position as the applicator is fully withdrawn from the container.

FIG. 8 illustrates the operation of unlocking the gripping member 202 from the receptacle 201 and taking out the applicator 206 from the receptacle 201. The sidewall of the wiper 203 having plurality of protrusions 208 on its outer diameter is capable of being folded inwards when a component with a diameter more than the diameter of the wiper is caused to travel from its distal end to the proximal end and in the process take up a wiping configuration. As represented by FIG. 8, the applicator 206 when comes in contact with the distal end of the wiper 203, causes the sidewall to fold inwards and thereby take up a wiping configuration, In the wiping configuration, the protrusions 208 are in contact with the applicator element 206 and define an interstice between the adjacent protrusions to capture the residue and wipe off the applicator 206. FIG. 9 represents the condition when the applicator 206 has been fully withdrawn for application. As the applicator 206 is no more in contact with the wiper 203, the outer sidewall of wiper 203 goes back to its relaxed position and unfolds. In non wiping condition the sidewall having plurality of protrusions 208 is in its relaxed position and the protrusions 208 are not in engagement with the stem 205 or the applicator 206.

Figure 10:
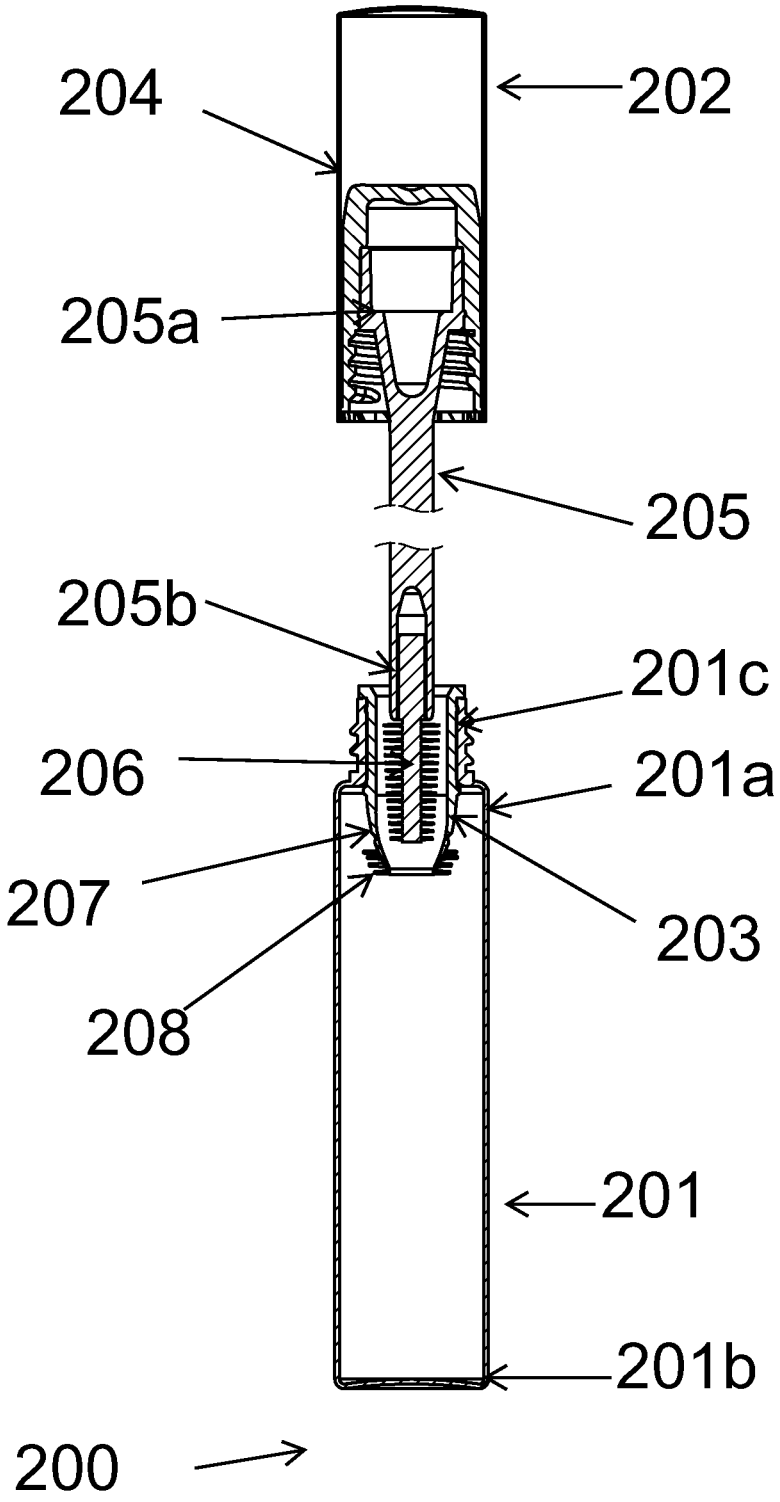
FIG. 10 is a cross sectional view of the container as shown in FIG. 7 showing the wiping member in a relaxed position as the applicator is inserted into the container.
Figure 11:
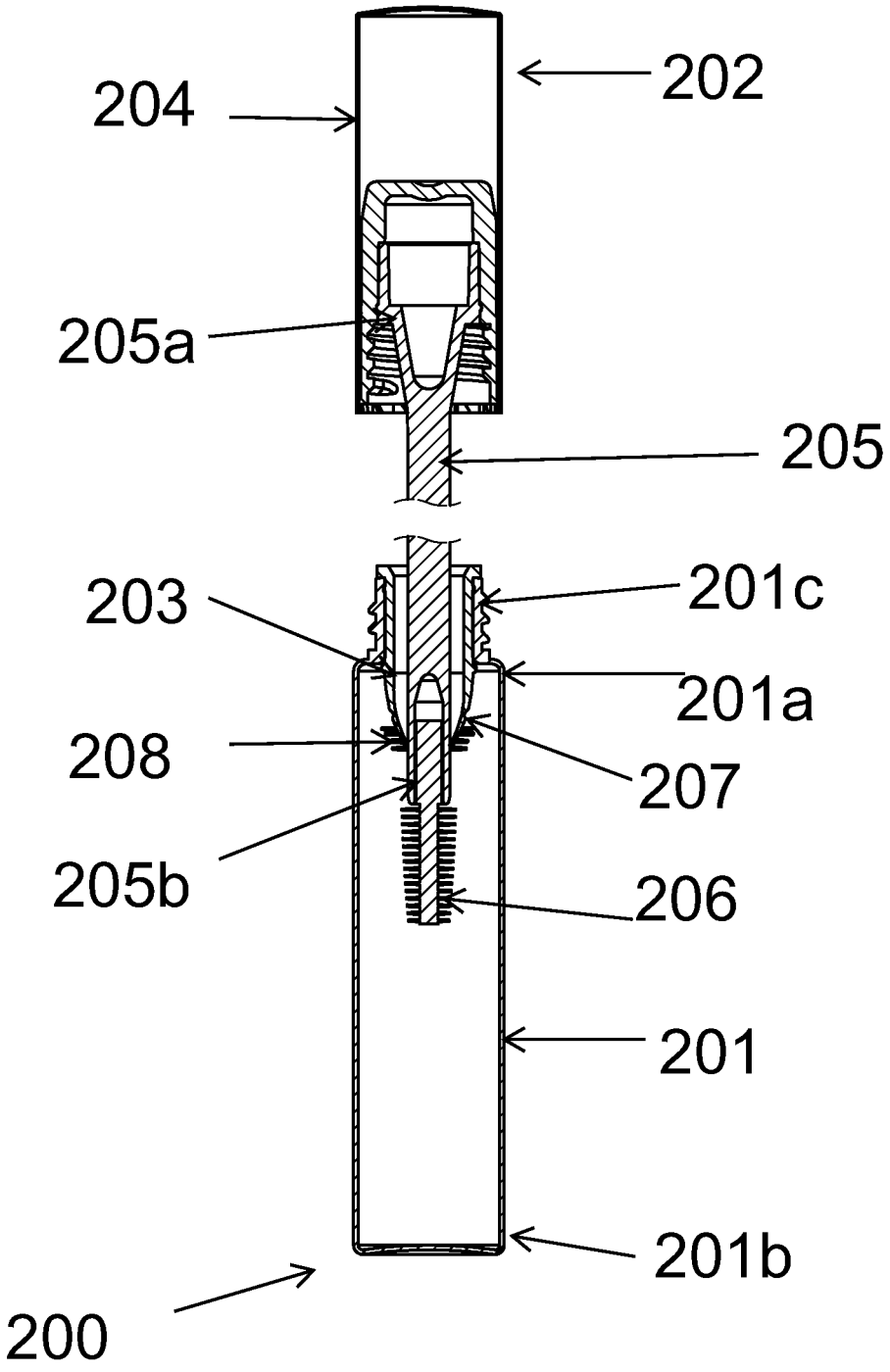
FIG. 11 is a cross sectional view of the container as shown in FIG. 7 showing the wiping member in a relaxed position as the applicator is fully inserted into the container.

FIGS. 10 and 11 illustrate the operation of returning back the applicator 206 into the receptacle 201. As the applicator 206 is being returned to the receptacle 201, the stem 205 and the applicator 206 do not come in contact with the protrusions 208 on the sidewall of the wiper 203 as the sidewall is in relaxed position. The wiper member 203 according to the present invention provides for efficient wiping of the applicator when being withdrawn from the container and further prevents reverse wiping action to take place.

The materials suitable for forming the receptacle may be any suitable polymeric material such as polyprolpylene while the gripping member may be formed of any suitable polymeric member such as acrylonitrile butadiene styrene. The material of applicator element may be any suitable polymeric material as nylon or could be a suitable metal. The stem may be formed of polyacetal or any other suitable material. The aforementioned materials for forming various parts of the container of the present invention are an example, however other suitable materials may also be used. Depending upon the substance being used in the receptacle, a variety of sizes and shapes of the applicator element can be utilized. The applicator element may be constructed of a porous or non-porous rubber, fabric mesh, felt material, foamed polymers, sponge material, Hydrel™, TPE or any other suitable material. Also, the applicator could have any suitable shape depending on the kind of application required. It could have a shape other than cylindrical such as ovular, tapered or any other suitable shape.

The wiper member be may be produced from an elastomer or any other elastic material allowing the folding and unfolding of the outer sidewall of the wiper member. The wiper member may be formed from a thermoplastic, elastomeric, or thermoplastic elastomeric material, for example, a synthetic or natural rubber, a polyurethane, an olefinic homo- or copolymer, e.g., polyethylene, especially low density polyethylene, or an ethylene-unsaturated ester copolymer, for example an ethylene-vinyl acetate copolymer. Other suitable materials may be low-density polyethylene or any suitable deformable material such as Hytrel. The wiper member may be molded as a single piece from an elastically deformable material or may be formed of a laminate or blend of two or more such materials. Further, the wiper member may be constructed from a blend of a rigid and a flexible/elastomeric material or it may be constructed in two parts where one part comprises of a rigid material and second part comprises an elastomeric material.

Although the above description and drawings show the container being cylindrical, the shapes and profile cross section thereof are not limited to the same.

These and further aspects which will be apparent to the expert of the art are attained by an adjustable applicator in accordance with the main claim.

While the foregoing is directed to embodiments of the present invention, other and further embodiments of the invention may be devised without departing from the basic scope thereof, and the scope thereof is determined by the claims that follow.

What is claimed is:

1. A wiper member for a container for packaging and dispensing products said wiper member comprising a housing, said housing having a proximal end and a distal end that define an opening, said housing having at least one sidewall, the at least one sidewall taking up a wiping configuration and a non-wiping configuration when a component is caused to travel through the wiper member;

wherein an outer surface of a lower portion of the at least one sidewall comprises a wiping surface;

wherein the lower portion of the at least one sidewall is capable of folding inwardly upon itself into said housing;

wherein in an initial relaxed position of the wiper member, the opening at the distal end of said housing has a first diameter;

wherein in the initial relaxed position of the wiper member, the lower portion of the at least one sidewall is in unfolded position and the component is not in contact with said housing;

wherein in the wiping configuration, the lower portion of the at least one sidewall folds inwardly upon itself into said housing such that the wiping surface moves inwardly into said housing and forms a wiping orifice inside said housing;

wherein the wiping orifice has a second diameter; and wherein the second diameter is smaller than the first diameter.

2. The wiper member according to claim 1 wherein the outer surface of the lower portion of the at least one sidewall is having a plurality of protrusions extending outwards from the outer surface of the lower portion of the at least one sidewall.

3. The wiper member according to claim 2 wherein the lower portion of the at least one sidewall folds inwardly upon itself into said housing such that the plurality of protrusions faces inwardly in to said housing and towards the component to be wiped in the wiping configuration and the lower portion of the at least one sidewall unfolds such that the plurality of protrusions faces away from the component in the non-wiping configuration.

4. The wiper member according to claim 2 wherein the wiper member comprises a proximal end and a distal end and wherein the wiper member takes up the wiping configuration when the component is caused to travel from the distal end of the wiper member to the proximal end of the wiper member and the non-wiping configuration as the component travels in a reverse direction.

5. The wiper member according to claim 4 wherein in the wiping configuration, the lower portion of the at least one sidewall folds inwardly in to said housing such that the plurality of protrusions on the lower portion of the at least one sidewall defines an interstice inside said housing for wiping the component.

6. The wiper member according to claim 2 wherein the plurality of protrusions have a shape such as flange, disc-shaped, finger or cilia.

7. The wiper member according to claim 6 wherein the plurality of protrusions occupy a portion of the outer surface of the lower portion of the at least one sidewall of the wiper member.

8. A container for packaging and dispensing a substance comprising a receptacle, a gripping member, the gripping member comprising a cap, a stem and an applicator element, the stem comprising a proximal end and a distal end wherein the stem is connected to the applicator element at its distal end and to the cap at its proximal end, the receptacle has an open end and a closed end thereby forming a cavity for storage of product, and a wiper member as claimed in claim 1, said wiper member being fitted onto the neck of the container, and wherein the at least one sidewall taking up a wiping configuration and a non-wiping configuration when the gripping member is caused to travel through the wiper member.

9. The wiper member according to claim 1 wherein the second diameter is at least 20% smaller than the first diameter.

10. A wiper member comprising a housing, said housing having a proximal end and a distal end that define an opening, said housing of the wiper member comprises at least one sidewall wherein the at least one sidewall of the wiper member takes up a wiping configuration and a non-wiping configuration when a component is caused to travel through the wiper member;

wherein an outer surface of a lower portion of the at least one sidewall comprises a plurality of protrusions;

wherein the lower portion of the at least one sidewall is capable of folding inwardly upon itself into said housing;

wherein in an initial relaxed position of the wiper member, the opening at the distal end of said housing has a first diameter;

wherein in the initial relaxed position of the wiper member, the lower portion of the at least one sidewall is in unfolded position and the component is not in contact with said housing;

wherein in the wiping configuration, the lower portion of the at least one sidewall folds inwardly upon itself into said housing such that the plurality of protrusions moves inwardly into said housing and forms an interstice inside said housing;

wherein the interstice has a second diameter; and wherein the second diameter is smaller than the first diameter.

11. The wiper member according to claim 10 wherein the at least one sidewall is having fold-lines and wherein the at least one sidewall folds inwardly in to said housing along the fold lines when the component is caused to travel from the distal end of said housing to the proximal end of said housing such that the wiper member takes up the wiping configuration.

12. The wiper member according to claim 10 wherein the at least one sidewall unfolds as the component comes in contact with the distal end of said housing while travelling from the proximal end of said housing to the distal end of said housing such that the wiper member takes up the non-wiping configuration.

13. The wiper member according to claim 10 wherein the plurality of protrusions are integrally molded with the lower portion of the at least one sidewall.

* * * * *